US009460705B2

(12) United States Patent
Agiomyrgiannakis et al.

(10) Patent No.: US 9,460,705 B2
(45) Date of Patent: Oct. 4, 2016

(54) DEVICES AND METHODS FOR WEIGHTING OF LOCAL COSTS FOR UNIT SELECTION TEXT-TO-SPEECH SYNTHESIS

(71) Applicant: Google Inc., Mountain View, CA (US)

(72) Inventors: Ioannis Agiomyrgiannakis, Mountain View, CA (US); Ibrahim Badr, Mountain View, CA (US)

(73) Assignee: Google Inc., Mountain View, CA (US)

( * ) Notice: Subject to any disclaimer, the term of this patent is extended or adjusted under 35 U.S.C. 154(b) by 426 days.

(21) Appl. No.: 14/087,260

(22) Filed: Nov. 22, 2013

(65) Prior Publication Data

US 2015/0134339 A1 May 14, 2015

Related U.S. Application Data

(60) Provisional application No. 61/904,105, filed on Nov. 14, 2013.

(51) Int. Cl.
*G10L 13/07* (2013.01)

(52) U.S. Cl.
CPC ..... *G10L 13/07* (2013.01)

(58) Field of Classification Search
CPC ..... G10L 13/07
USPC ..... 704/260
See application file for complete search history.

(56) References Cited

U.S. PATENT DOCUMENTS 6,233,545 B1 * 5/2001 Datig ..... G06N 3/004 704/2
6,449,595 B1 * 9/2002 Arslan ..... G06T 13/205 348/515
6,961,704 B1 11/2005 Phillips et al.
7,013,278 B1 3/2006 Conkie
7,165,030 B2 1/2007 Yi et al.
7,219,056 B2 * 5/2007 Axelrod ..... G10L 15/01 703/2
7,979,280 B2 7/2011 Wouters et al.
2003/0055641 A1 * 3/2003 Yi ..... G10L 13/06 704/238
2005/0102144 A1 * 5/2005 Rapoport ..... G10L 13/033 704/269
2011/0313772 A1 12/2011 Conkie
2013/0262096 A1 * 10/2013 Wilhelms-Tricarico G10L 25/90 704/202

OTHER PUBLICATIONS

Bellegarda J., "A Dynamic Cost weighting framework for unit-selection Text-to-Speech synthesis", IEEE Transactions on Audio, Speech and Language Processing. Aug. 2010.

* cited by examiner

*Primary Examiner* — Michael N Opsasnick
(74) *Attorney, Agent, or Firm* — McDonnell Boehnen Hulbert & Berghoff LLP

(57) ABSTRACT

A device may determine a representation of text that includes a first linguistic term associated with a first set of speech sounds and a second linguistic term associated with a second set of speech sounds. The device may determine a plurality of joins between the first set and the second set. A given join may be indicative of concatenating a first speech sound from the first set with a second speech sound from the second set. A given local cost of the given join may correspond to a weighted sum of individual cost. A given individual cost may be weighted based on a variability of the given individual cost in the plurality of joins. The device may provide a sequence of speech sounds indicative of a pronunciation of the text based on a minimization of a sum of local costs of adjacent speech sounds in the sequence.

20 Claims, 5 Drawing Sheets

DEVICES AND METHODS FOR WEIGHTING OF LOCAL COSTS FOR UNIT SELECTION TEXT-TO-SPEECH SYNTHESIS

CROSS-REFERENCE TO RELATED APPLICATION

The present disclosure claims priority to U.S. Provisional Patent Application Ser. No. 61/904,105, filed on Nov. 14, 2013, the entirety of which is herein incorporated by reference.

BACKGROUND

Unless otherwise indicated herein, the materials described in this section are not prior art to the claims in this application and are not admitted to be prior art by inclusion in this section.

A text-to-speech system (TTS) may be employed to generate synthetic speech based on text. Many example TTS systems exist. A first example TTS system may concatenate one or more recorded speech units to generate synthetic speech. A second example TTS system may concatenate one or more statistical models of speech to generate synthetic speech. A third example TTS system may concatenate recorded speech units with statistical models of speech to generate synthetic speech. In this regard, the third example TTS system may be referred to as a hybrid TTS system.

SUMMARY

In one example, a method is provided that comprises determining a representation of text that includes a first linguistic term and a second linguistic term by a computing device. The first linguistic term may be associated with a first set of speech sounds that include pronunciations of the first linguistic term. The second linguistic term may be associated with a second set of speech sounds that include pronunciations of the second linguistic term. The method further comprises determining a plurality of joins between the first set and the second set by the computing device. A given join may be indicative of concatenating a first speech sound from the first set with a second speech sound from the second set. A given local cost of the given join may correspond to a weighted sum of individual costs. A given individual cost may be weighted based on a variability of the given individual cost in the plurality of joins. The method further comprises providing a sequence of speech sounds indicative of a pronunciation of the text based on a minimization of a sum of local costs of adjacent speech sounds in the sequence by the computing device. The first speech sound and the second speech sound may be included in the sequence based on the given local cost of the given join minimizing the sum.

In another example, a computer readable medium is provided. The computer readable medium may have instructions stored therein that when executed by a device cause the device to perform operations. The operations comprise determining a representation of text that includes a first linguistic term and a second linguistic term. The first linguistic term may be associated with a first set of speech sounds that include pronunciations of the first linguistic term. The second linguistic term may be associated with a second set of speech sounds that include pronunciations of the second linguistic term. The operations further comprise determining a plurality of joins between the first set and the second set. A given join may be indicative of concatenating a first speech sound from the first set with a second speech sound from the second set. A given local cost of the given join may correspond to a weighted sum of individual costs. A given individual cost may be weighted based on a variability of the given individual cost in the plurality of joins. The operations further comprise providing a sequence of speech sounds indicative of a pronunciation of the text based on a minimization of a sum of local costs of adjacent speech sounds in the sequence. The first speech sound and the second speech sound may be included in the sequence based on the given local cost of the given join minimizing the sum.

In yet another example, a computing device is provided that comprises one or more processors and data storage configured to store instructions, that when executed by the one or more processors, cause the computing device to determine a representation of text that includes a first linguistic term and a second linguistic term. The first linguistic term may be associated with a first set of speech sounds that include pronunciations of the first linguistic term. The second linguistic term may be associated with a second set of speech sounds that include pronunciations of the second linguistic term. The instructions may further cause the computing device to determine a plurality of joins between the first set and the second set. A given join may be indicative of concatenating a first speech sound from the first set with a second speech sound from the second set. A given local cost of the given join may correspond to a weighted sum of individual costs. A given individual cost may be weighted based on a variability of the given individual cost in the plurality of joins. The instructions may further cause the computing device to provide a sequence of speech sounds indicative of a pronunciation of the text based on a minimization of a sum of local costs of adjacent speech sounds in the sequence. The first speech sound and the second speech sound may be included in the sequence based on the given local cost of the given join minimizing the sum.

These as well as other aspects, advantages, and alternatives, will become apparent to those of ordinary skill in the art by reading the following detailed description, with reference where appropriate to the accompanying figures.

DETAILED DESCRIPTION

Figure 1:
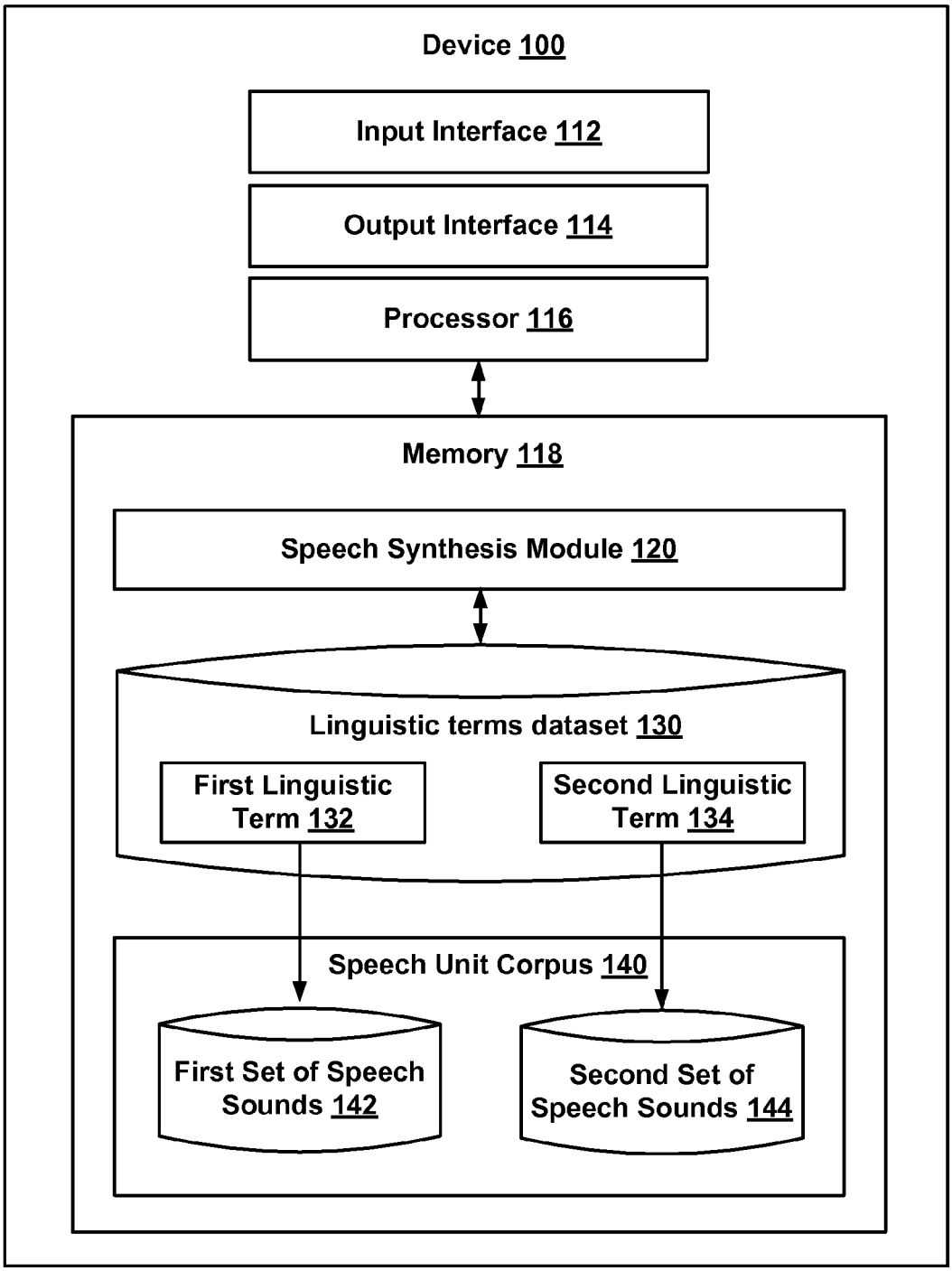
FIG. 1 illustrates an example speech synthesis device, in accordance with at least some embodiments described herein.

The following detailed description describes various features and functions of the disclosed systems and methods with reference to the accompanying figures. In the figures, similar symbols identify similar components, unless context dictates otherwise. The illustrative system, device and method embodiments described herein are not meant to be limiting. It may be readily understood by those skilled in the art that certain aspects of the disclosed systems, devices and methods can be arranged and combined in a wide variety of different configurations, all of which are contemplated herein.

Text-to-speech synthesis systems (TTS) may be deployed in various environments to provide speech-based user interfaces for example. Some of these environments include residences, businesses, vehicles, etc.

In some examples, TTS may provide audio information from devices such as large appliances, (e.g., ovens, refrigerators, dishwashers, washers and dryers), small appliances (e.g., toasters, thermostats, coffee makers, microwave ovens), media devices (e.g., stereos, televisions, digital video recorders, digital video players), communication devices (e.g., cellular phones, personal digital assistants), as well as doors, curtains, navigation systems, and so on. For example, a TTS in a navigation system may obtain text that includes directions to an address, and then guide the user of the navigation system to the address by generating audio that corresponds to the text with the directions.

In some examples, the TTS may generate synthesized audio that corresponds to the text by concatenating a sequence of speech sounds that correspond to linguistic terms that make up the text. For example, a first linguistic term may correspond to the letter "c" in the word "cat." The TTS, for example, may concatenate a first speech sound that corresponds to the letter "c" with a second speech sound that corresponds to the letter "a" and a third speech sound that corresponds to the letter "t" to generate synthetic audio for a pronunciation of the word "cat."

In some examples, the TTS may obtain a first set of speech sounds that include pronunciations of the first linguistic term, and select the first speech sound from the first set of speech sounds. For example, the TTS may receive the first set of speech sounds that include pronunciations of the letter "c," and then select the first speech sound that matches a desired context of the letter "c" in the word "cat." Similarly, in some examples, the TTS may obtain a second set of speech sounds that include pronunciations of a second linguistic term (e.g., letter "a" in the word "cat"), and select the second speech sound from the second set.

In some examples, the selection of the first speech sound and the second speech sound may be based on a minimization of a sum of local costs of adjacent speech sounds in the sequence of speech sounds. For example, a given local cost of a given join between the first speech sound and the second speech sound may correspond to a measure pertaining to acoustic and prosodic context of the first speech sound and the second speech sound when the first speech sound and the second speech sound are concatenated to represent the first linguistic term and the second linguistic term. Thus, for example, minimizing the sum of local costs may correspond to identifying the sequence of speech sounds that is most likely to match a given pronunciation of the text.

Within examples, methods, devices, and systems are provided for determining local costs to facilitate identifying a sequence of speech sounds indicative of a pronunciation of text.

Referring now to the figures, FIG. 1 illustrates an example speech synthesis device 100, in accordance with at least some embodiments described herein. The device 100 includes an input interface 112, an output interface 114, a processor 116, and a memory 118.

The device 110 may comprise a computing device such as a smart phone, digital assistant, digital electronic device, body-mounted computing device, personal computer, or any other computing device configured to execute instructions included in the memory 118 to operate the device 110. Although not illustrated in FIG. 1, the device 110 may include additional components, such as a camera, an antenna, or any other physical component configured, based on instructions in the memory 118 executable by the processor 116, to operate the device 110. The processor 116 included in the device 110 may comprise one or more processors configured to execute instructions in the memory 118 to operate the device 110.

The input interface 112 may include an input device such as a keyboard, touch-screen display, mouse, or any other component configured to provide an input signal comprising text content to the processor 116. The output interface 114 may include an audio output device, such as a speaker, headphone, or any other component configured to receive an output audio signal from the processor 116, and output sounds that may indicate speech content based on the output audio signal.

Additionally or alternatively, the input interface 112 and/or the output interface 114 may include network interface components configured to, respectively, receive and/or transmit the input signal and/or the output signal described above. For example, an external computing device may provide the input signal to the input interface 112 via a communication medium such as Wifi, WiMAX, Ethernet, Universal Serial Bus (USB), or any other wired or wireless medium. Similarly, for example, the external computing device may receive the output signal from the output interface 114 via the communication medium described above.

The memory 118 may include one or more memories (e.g., flash memory, Random Access Memory (RAM), solid state drive, disk drive, etc.) that include software components configured to provide instructions executable by the processor 116 pertaining to the operation of the device 110. Although illustrated in FIG. 1 that the memory 118 is physically included in the device 110, in some examples, the memory 118 or some components included thereon may be physically stored on a remote computing device. For example, some of the software components in the memory 118 may be stored on a remote server accessible by the device 110.

The memory 118 may include a speech synthesis module 120 configured to provide instructions executable by the processor 116 to cause the device 110 to generate a synthetic speech audio signal via the output interface 114. The speech synthesis module 120 may comprise, for example, a software component such as an application programming interface (API), dynamically-linked library (DLL), or any other software component configured to provide the instructions described above to the processor 116. Further, in some examples, the speech synthesis module 120 may receive text or a representation thereof via the input interface 112 and determine the synthetic speech audio signal corresponding to the received text.

To facilitate the synthesis described above, the speech synthesis module 120 may utilize linguistic terms dataset 130 stored in the memory 118. The linguistic terms dataset 130 may include a plurality of linguistic terms such as first linguistic term 132 and second linguistic term 134. In some examples, a linguistic term may correspond to a portion of the input text and may be indicative of a representation of the portion that includes one or more phonemes. For example, the text received via the input interface 112 may be represented by a phonemic representation (e.g., transcription). Within some examples, the term "phonemic representation" may refer to the text presented as one or more phonemes indicative of a pronunciation of the text, perhaps by representing the text as a sequence of at least one phoneme. The at least one phoneme may be determined using an algorithm, method, and/or process suitable for processing the text, in order to determine the phonemic representation.

In some examples, a phoneme may be considered to be a smallest segment (or a small segment) of an utterance that encompasses a meaningful contrast with other segments of utterances. Thus, a word typically includes one or more phonemes. For example, phonemes may be thought of as utterances of letters; however, some phonemes may present multiple letters. An example phonemic representation for the English language pronunciation of the word "cat" may be /k/ /ae/ /t/, including the phonemes /k/, /ae/, and /t/ from the English language. In another example, the phonemic representation for the word "dog" in the English language may be /d/ /aw/ /g/, including the phonemes /d/, /aw/, and /g/ from the English language.

Different phonemic alphabets exist, and these alphabets may have different textual representations for the various phonemes therein. For example, the letter "a" in the English language may be represented by the phoneme /ae/ for the sound in "cat," by the phoneme /ey/ for the sound in "ate," and by the phoneme /ah/ for the sound in "beta." Other phonemic representations are possible. As an example, in the English language, common phonemic alphabets contain about 40 distinct phonemes.

In some examples, the first linguistic term 132 and/or the second linguistic term 134 may correspond to one or more phonemes. For example, the first linguistic term 132 may correspond to the phoneme /k/ and the second linguistic term 134 may correspond to the phoneme /ae/. Thus, for example, the speech synthesis module 120 may associate an input text for the word "cat" to the first linguistic term 132, the second linguistic term 134, and a third linguistic term (not shown in FIG. 1) that corresponds to the phoneme /t/. Although illustrated in FIG. 1 that the linguistic terms dataset 130 includes only two linguistic terms, in some examples, the linguistic terms dataset 130 may include more linguistic terms. For example, the linguistic terms dataset 130 may include a linguistic term for every phoneme in the English language.

Speech unit corpus 140 may include a plurality of speech sounds such as a first set of speech sounds 142 and a second set of speech sounds 144. In some examples, the speech unit corpus 140 may comprise a database that includes the first set of speech sounds 142 and/or the second set of speech sounds 144 along with identifiers that associate speech sounds to their respective linguistic term. In some examples, the speech unit corpus 140 may comprise a plurality of audio files for which the first linguistic term 132 and/or the second linguistic term 134 have identifiers. In some examples, each linguistic term in the linguistic term dataset 130 may be associated with a plurality of speech sounds included in the speech unit corpus 140. For example, as illustrated in FIG. 1, the first linguistic term 132 may be associated with the first set 142, and the second linguistic term 134 may be associated with the second set 144. For example, the first set 142 may include pronunciations of the first linguistic term 132. Similarly, the second set 144 may include pronunciations of the second linguistic term 134.

Although illustrated in FIG. 1 that the speech unit corpus 140 includes only two sets of speech sounds, in some examples, the speech unit corpus 140 may include more sets of speech sounds. For example, the speech unit corpus 140 may include a plurality of speech sounds associated with each linguistic term in the linguistic terms dataset 130.

The generation of the first set of speech sounds 142 and the second set of speech sounds 144 in the speech unit corpus 140 may be performed using various methods. For example, the device 100 or any other computing device may receive configuration data that includes text such as "the camera can take an image of a bat" along with audio recitation of the text. In this example, the device 110 may then extract audio from the recitation for the first linguistic term 132 that includes a pronunciation of the letter "c" in the word "camera" and the word "can" and store the extracted audio as two speech sounds in the first set of speech sounds 142. Further, in this example, the device 110 may extract audio for the second linguistic term 134 that includes pronunciations of the letter "t" in the word "take" and in the word "bat" and store the extracted audio as two speech sounds in the second set of speech sounds 144. In some examples, a given speech sound may be included in more than one set of speech sounds in the corpus 140. For example, the given speech sound in the first set 142 may include a pronunciation of the letters "ca" and the given speech sound may also be included in a third set of speech sounds (not shown in FIG. 1) that is associated with a linguistic term that corresponds to the letter "a." Further, in this example, the device 100 may then generate synthetic audio for the word "cat" by selecting one of the speech sounds in the first set 142 and concatenating the selected speech sound with the one speech sound in the second set 144 (e.g., concatenate speech sounds of "ca" and "at"). Other methods for generating the speech unit corpus 140 are possible such as analyzing audio data from more than one speaker, for example.

In some examples, the implementation of the speech synthesis module 120 to generate the synthetic audio signal may include methods such as concatenative speech unit synthesis. In one example of concatenative speech unit synthesis, the speech synthesis module 120 may determine a hidden Markov model (HMM) chain that corresponds to the phonemic representation of the input text. For example, the linguistic terms dataset 130 may be implemented as an HMM model dataset where the first linguistic term 132 corresponds to a first HMM and the second linguistic term 134 corresponds to a second HMM. For example, the first HMM may model a system such as a Markov process with unobserved (i.e., hidden) states. Each HMM state may be represented as a multivariate Gaussian distribution that characterizes statistical behavior of the state. For example, the Gaussian distribution may include a representation of a given speech sound of the first set 142 (e.g., spectral features of the audio utterance). Additionally, each state may also be associated with one or more state transitions that specify a probability of making a transition from a current state to another state. Thus, the speech synthesis module 120 may perform concatenative speech unit synthesis by concatenating speech units (e.g., speech sounds) that correspond to the HMM chain to generate the synthetic audio signal via the output interface 114.

When applied to a device such as the device 100, in some examples, the combination of the multivariate Gaussian distributions and the state transitions for each state may define a sequence of utterances corresponding to one or more phonemes. For example, the HMM may model the sequences of phonemes that define words in the input text received via the input interface 112. Thus, some HMM-based acoustic models may also take into account phoneme context when mapping a sequence of utterances to one or more words.

As mentioned earlier, the selection of a sequence of speech sounds that represent a pronunciation of the text input via the input interface 112 may be based on a minimization of local costs of adjacent speech sounds in the sequence. For example, the sequence may include the first speech sound from the first set 142 and the second speech sound from the second set 144 that have a given local cost of concatenation that minimizes the sum. For example, the speech synthesis module 120 may concatenate the first speech sound that corresponds to pronunciation of the letters "ca" with the second speech sound that corresponds to pronunciation of the letters "at" to synthesize a pronunciation for the word "cat" based on the given local cost minimizing the sum. For example, where the second speech sound corresponds to pronunciation of the letters "at," the given local cost may be lower than the local cost of another speech sound in the second set 144 that corresponds to a pronunciation of the letters "ta."

In some examples, minimizing the sum of local costs between adjacent speech sounds in the sequence may be implemented by finding an optimal path (e.g., minimum distance) in a weighted directed Viterbi graph. For example, a first node in the Viterbi graph may correspond to the first speech sound from the first set 142, a second node may correspond to the second speech sound from the second set 144, and a given edge in the Viterbi graph between the first node and the second node may correspond to the given local cost of concatenating the first speech sound with the second speech sound.

Figure 2:
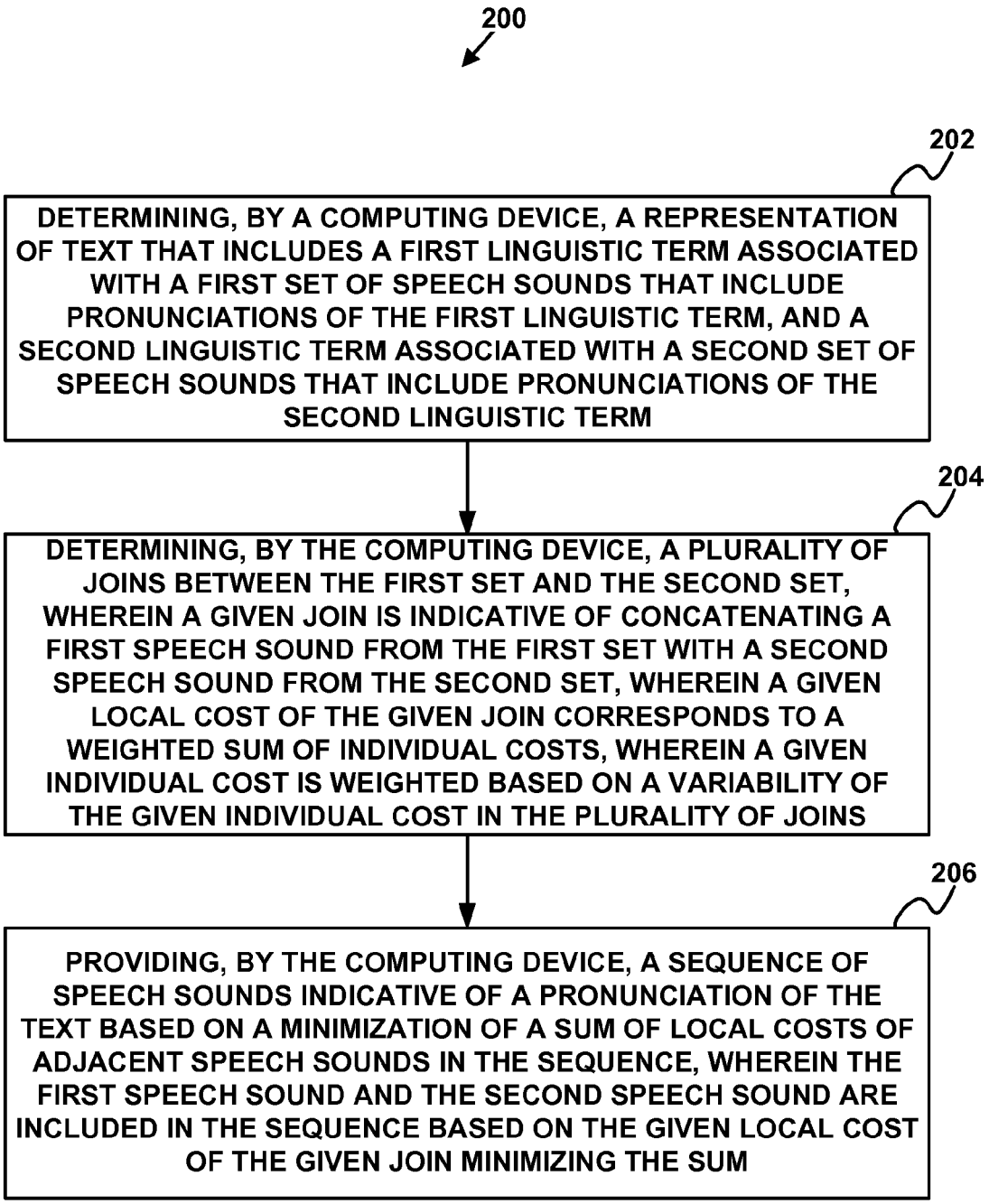
FIG. 2 is a block diagram of an example method for determining a sequence of speech sounds that corresponds to a pronunciation of text, in accordance with at least some embodiments described herein.

FIG. 2 is a block diagram of an example method 200 for determining a sequence of speech sounds that corresponds to a pronunciation of text, in accordance with at least some embodiments described herein. Method 200 shown in FIG. 2 presents an embodiment of a method that could be used with the device 100, for example. Method 200 may include one or more operations, functions, or actions as illustrated by one or more of blocks 202-206. Although the blocks are illustrated in a sequential order, these blocks may in some instances be performed in parallel, and/or in a different order than those described herein. Also, the various blocks may be combined into fewer blocks, divided into additional blocks, and/or removed based upon the desired implementation.

In addition, for the method 200 and other processes and methods disclosed herein, the flowchart shows functionality and operation of one possible implementation of present embodiments. In this regard, each block may represent a module, a segment, a portion of a manufacturing or operation process, or a portion of program code, which includes one or more instructions executable by a processor for implementing specific logical functions or steps in the process. The program code may be stored on any type of computer readable medium, for example, such as a storage device including a disk or hard drive. The computer readable medium may include non-transitory computer readable medium, for example, such as computer-readable media that stores data for short periods of time like register memory, processor cache and Random Access Memory (RAM). The computer readable medium may also include non-transitory media, such as secondary or persistent long term storage, like read only memory (ROM), optical or magnetic disks, compact-disc read only memory (CD-ROM), for example. The computer readable media may also be any other volatile or non-volatile storage systems. The computer readable medium may be considered a computer readable storage medium, for example, or a tangible storage device.

In addition, for the method 200 and other processes and methods disclosed herein, each block in FIG. 2 may represent circuitry that is wired to perform the specific logical functions in the process.

At block 202, the method 200 includes determining a representation of text that includes a first linguistic term associated with a first set of speech sounds that include pronunciations of the first linguistic term, and a second linguistic term associated with a second set of speech sounds that include pronunciations of the second linguistic term by a computing device.

In some examples, the first linguistic term and the second linguistic term may include one or more phonemes. For example, the computing device may receive input text such as the word "cat." Further, in this example, the device may determine the representation of the text such as phonemic representation /k/ /ae/ /t/. For example, the first linguistic term may correspond to the phoneme /k/ and the second linguistic term may correspond to the phonemes /ae/. In some examples, the first and/or second linguistic terms may correspond to more than one phoneme. For example, the first linguistic term may correspond to the phonemes /k/ /ae/. Additionally, in this example, the computing device may obtain the first set of speech sounds that include pronunciations of the first linguistic term and the second set of speech sounds that include pronunciations of the second linguistic term from a speech corpus such as speech corpus 140 of FIG. 1.

At block 204, the method 200 includes determining a plurality of joins between the first set and the second set by the computing device. A given join may be indicative of concatenating a first speech sound from the first set with a second speech sound from the second set. A given local cost of the given join may correspond to a weighted sum of individual costs. A given individual cost may be weighted based on a variability of the given individual cost in the plurality of joins.

As mentioned earlier, the first linguistic term may be associated with the first set of speech sounds that include pronunciations of the first linguistic term. Similarly, the second linguistic term may be associated with the second set of speech sounds. In some examples, the device may determine the plurality of joins that correspond to possible concatenations between speech sounds in the first set and speech sounds in the second set. Table 1 illustrates example speech sounds S1-S5 in the first set and the second set.

TABLE 1

| First Set of Speech Sounds | Second Set of Speech Sounds |
|---|---|
| S1 | S4 |
| S2 | S5 |
| S3 | |

In the example at block 202, the speech sounds S1-S3 may correspond to pronunciations of the letter "c" in the word "cat" and the speech sounds S4-S5 may correspond to pronunciations of the letter "a" in the word "cat." Although illustrated in Table 1 that the first set and the second set include only five speech sounds, in some examples, the first set and the second set may include more or less speech sounds. Thus, for example, there may be several combinations (e.g., joins) between the first set and the second set that correspond to pronunciations of the letters "ca" in the word "cat." Table 2 illustrates example plurality of joins for the first set and second set in Table 1 along with local costs associated with the plurality of joins.

TABLE 2

| Plurality of Joins | Local Costs |
|---|---|
| S1, S4 | 3.6 |
| S1, S5 | 4.2 |
| S2, S4 | 9.6 |
| S2, S5 | 7.8 |
| S3, S4 | 2.1 |
| S3, S5 | 5.7 |

Thus, for example, if the first speech sound selected corresponds to S1 and the second speech sound selected corresponds S5, the given local cost may correspond to the value of 4.2 as illustrated in Table 2.

In some examples, the given local cost may be determined to correspond to a weighted sum of individual costs. The individual costs, for example, may be indicative of a measure of acoustic context and/or prosodic context of the selected first speech sound and second speech sound when concatenated to represent the pronunciation of the first linguistic term and the second linguistic term.

In some examples, the individual costs may include costs indicative of disparity between the first speech sound and the first linguistic term (e.g., acoustic context). Similarly, in some examples, the individual costs may be indicative of disparity between the second speech sound and the second linguistic term. Thus, for example, the individual costs may be indicative of a likelihood that acoustic features of the first speech sound and the second speech sound correspond to the first linguistic term and the second linguistic term. In speech processing, for example, such costs may be referred to as target costs. For example, speech sounds that correspond to pronunciations of the letters "ka," "pa," and "ta" may be assigned various target costs when matched with the first linguistic term "c" and the second linguistic term "a" in the context of the word "cat." Thus, for example, the TTS may select the first speech sound and the second speech sound that minimize the target cost (e.g., select "ka" in the example above). In some examples, speech sounds that correspond to pronunciation of the letters "ca" may have a target cost of zero.

In some examples, the individual costs may include costs indicative of disparity between concatenation features in the first speech sound (e.g., pronunciation of letter "c") and concatenation features in the second speech sound (e.g., pronunciation of letter "a"). In speech processing, for example, such costs may be referred to as join costs. The concatenation features may pertain to an acoustic transition between the first speech sound and the second speech sound when the first speech sound and the second speech sound are concatenated. For example, a first concatenation feature of the first speech sound may include a last fundamental frequency value (F0) (e.g., pitch of ending portion of the first speech sound), and a second concatenation feature of the second speech sound may include a first F0 (e.g., pitch of beginning portion of the second speech sound). In this example, the join cost may be indicative of a difference between the first concatenation feature and the second concatenation feature (e.g., difference in pitch). Thus, in some examples, minimizing the join cost may optimize prosody of the synthesized audio generated by the device and reduce discontinuity between concatenated speech sounds.

In some examples, the individual costs may be globally weighted when determining the given local cost to represent influence of a given individual cost on perception of concatenated speech sounds in a given speech corpus. For example, a first individual cost associated with an acoustic context (e.g., a given target cost) may be assigned a higher global weight than a second individual cost associated with a prosodic context (e.g., a given join cost). In some examples, such global weighting for speech sounds in the given speech corpus that includes the first set, the second set, and other sets of speech sounds associated with other linguistic terms may improve perception of synthesized audio pronunciation of the text. For example, such global weights may be tuned (e.g., adjusted) by a listener of the synthesized audio provided by the device.

In some examples, such global weighting in the given speech corpus may not differentiate between speech sounds within the plurality of joins associated with the first and second linguistic terms. For example, the plurality of joins may include speech sounds having low variability of the given individual cost. For example, all speech sounds in the plurality of joins may have a same duration (e.g., duration may be the given individual cost), and thus applying a high global weight for the duration cost may distinguish between speech sounds in the given speech corpus (e.g., in a global sense) but may not distinguish between the speech sounds in the plurality of joins.

Thus, in some examples, the method 200 may provide local weights for the individual costs based on a variability of the given individual cost in the plurality of joins. Table 3 illustrates the plurality of joins illustrated in Table 2 with example values for individual costs IC1 and IC2. Although illustrated in Table 3 that there are only two individual costs IC1 and IC2, in some examples, there may be more individual costs. For example, they may be three, four, five, or more individual costs.

TABLE 3

| Plurality of Joins | IC1 | IC2 | Local Costs |
|---|---|---|---|
| S1, S4 | 1.25 | 1.1 | 3.6 |
| S1, S5 | 1.65 | 0.9 | 4.2 |
| S2, S4 | 4.25 | 1.1 | 9.6 |
| S2, S5 | 3.35 | 1 | 7.8 |
| S3, S4 | 1.1 | 0.9 | 2.1 |
| S3, S5 | 2.3 | 1.1 | 5.7 |

As illustrated in Table 3, for example, the individual cost IC1 may exhibit more variability than the individual cost IC2. Thus, for example, the method 200 may assign a local weight for IC1 greater than a local weight for IC2. For example, the given local cost of the given join between the first speech sound S1 and the second speech sound S5 may be determined as: $2*IC1+1*IC2=2*1.65+1*0.9=4.2$ as illustrated in Table 3 where the local weights of IC1 and IC2, respectively, are 2 and 1. It is noted that in the example above, the local weights pertain to the plurality of joins between the speech sounds in the first set and the second set only. Thus, for example, for a second plurality of joins between other sets of speech sounds, the local weights of the individual costs IC1 and IC2 may be different than the local weights determined in the example above. Thus, in some examples, the method 200 provides a mechanism for dynamically weighting the individual costs at every concatenation point between adjacent speech sounds based on the variability of the individual costs in the corresponding plurality of joins.

At block 206, the method 200 includes providing a sequence of speech sounds indicative of a pronunciation of the text based on a minimization of a sum of local costs of adjacent speech sounds in the sequence by the computing device. The first speech sound and the second speech sound may be included in the sequence based on the given local cost of the given join minimizing the sum.

Referring back to the example at block 202, the first linguistic term and the second linguistic term may correspond, respectively, to the letter "c" and the letter "a" in the word "cat." Further, in this example, the letter "t" may correspond to a third linguistic term associated with a third set of speech sounds that includes one speech sound S6. Table 4 illustrates a second plurality of joins between the second set and the third set similarly to Table 2.

TABLE 4

| Second Plurality of Joins | Local Costs |
|---|---|
| S4, S6 | 10.9 |
| S5, S6 | 3.1 |

In some examples, the local costs illustrated in Table 4 may be determined similarly to the local costs determined for the plurality of joins illustrated in Table 3. For example, the local costs may correspond to the weighted sum of the individual costs IC1 and IC2. However, in this example, the local weights of the individual costs IC1 and IC2 may be based on the variability of the individual costs in the second plurality of joins. Thus, for example, the local weights of IC1 and IC2 may be different from the corresponding local weights of IC1 and IC2 in the calculation of the local costs illustrated in Table 3.

In some examples, the device may determine the sequence of speech sounds indicative of the pronunciation of the text (e.g., "cat") based on the minimization of the sum of local costs. For example, the sequence of speech sounds (S1, S4, S6) may have the sum of local costs that is determined as: 3.6+10.9=14.5 based on the values of the local costs in Tables 2 and 4. Similarly, for example, the sequence (S1, S5, S6) may have the sum of local costs that is determined as: 4.2+3.1=7.3.

Thus, for example, the method 200 may select the sequence of speech sounds that minimizes the sum of local costs and provide the selected sequence as the pronunciation of the text. For example, the device may provide the sequence (S1, S5, S6) to represent the pronunciation of the word "cat" based on the given local cost of the given join between S1 and S5 (e.g., 4.2) minimizing the sum of local costs. In this example, the first speech sound corresponds to the speech sound S1 and the second speech sound corresponds to the speech sound S5. It is noted that although the local cost between the speech sounds S3 and S4 (e.g., 2.1) is less than the given local cost between the speech sounds S1 and S5, the sequence (S3, S4, S6) has a sum of local costs that is higher (e.g., 2.1+10.9=13), thus the sequence (S1, S5, S6) may be selected instead to minimize the sum of local costs (e.g., 4.2+3.1=7.3), for example.

Thus, as illustrated by the method 200, the sequence of speech sounds provided by the device may be different than a corresponding sequence provided without weighting the individual costs based on the variability at each concatenation point, for example.

Figure 3:
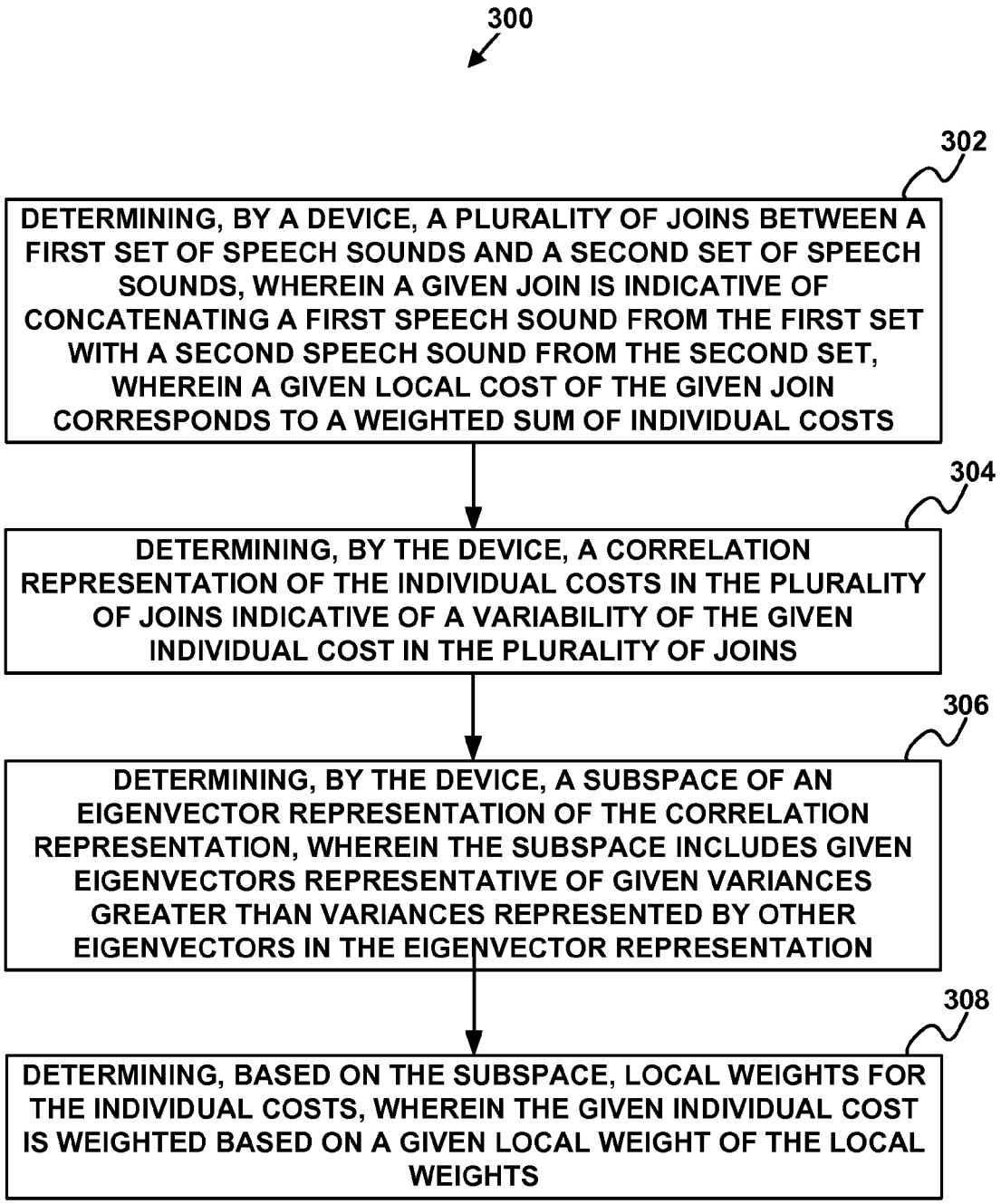
FIG. 3 is a block diagram of an example method for weighting individual costs based on eigenvector analysis, in accordance with at least some embodiments described herein.

FIG. 3 is a block diagram of an example method 300 for weighting individual costs based on eigenvector analysis, in accordance with at least some embodiments described herein. Method 300 shown in FIG. 3 presents an embodiment of a method that could be used with the device 100, for example. Method 300 may include one or more operations, functions, or actions as illustrated by one or more of 302-308. Although the blocks are illustrated in a sequential order, these blocks may in some instances be performed in parallel, and/or in a different order than those described herein. Also, the various blocks may be combined into fewer blocks, divided into additional blocks, and/or removed based upon the desired implementation.

At block 302, the method 300 includes determining a plurality of joins between a first set of speech sounds and a second set of speech sounds by a device. A given join may be indicative of concatenating a first speech sound from the first set with a second speech sound from the second set. A given local cost of the given join may correspond to a weighted sum of individual costs. For example, the first set and the second set may include, respectively, pronunciations of a first linguistic term and a second linguistic term similarly to the first set of speech sounds 142 and the second set of speech sounds 144 in FIG. 1. Thus, for example, the plurality of joins may be indicative of candidates for concatenation between the first set and the the second set. Additionally, for example, the given local cost may correspond to the weighted sum of individual costs, such as the individual costs IC1 and IC2 discussed in the method 200.

At block 304, the method 300 includes determining a correlation representation of the individual costs in the plurality of joins indicative of a variability of the given individual cost in the plurality of joins. In some examples, the method 300 may describe an example implementation for local weighting the individual costs as described in the method 200.

For example, the first set may include m speech sounds and the second set may include n speech sounds. Thus, in this example, the plurality of joins may include L=mn joins. Further, for example, the device may obtain P individual costs for the L joins. For example, where P=2, the individual costs may include IC1 and IC2 described in method 200. Thus, for example, the method 300 may include determining a matrix V that has P by L dimensions (e.g., L rows and P columns). The matrix V, for example, may include the individual costs of the plurality of joins.

Further, for example, the device may determine the correlation representation matrix C that describes of the variability of the individual costs P in the plurality of joins L as shown in equation [1]:

$$C = \frac{1}{L} V^T V \qquad [1]$$

In some examples, the correlation matrix C has P by P dimensions and is indicative of the variability of the individual costs in the plurality of joins represented by the matrix V.

At block 306, the method 300 includes determining a subspace of an eigenvector representation of the correlation representation by the device. The subspace may include given eigenvectors representative of given variances greater than variances represented by other eigenvectors in the eigenvector representation.

For example, the device may determine a P by P eigenvector matrix E (e.g., eigenvector representation) that includes eigenvectors $v_1, \ldots, v_z$ (where z=1, . . . , L) of the correlation matrix C described at block 304. For example, eigenvalues of the eigenvectors $v_1, \ldots, v_z$ included in the eigenvector matrix E may be indicative of variance of the eigenvectors $v_1, \ldots, v_z$. Since the correlation matrix C includes positive values, for example, the eigenvalues may also be positive.

Further, in some examples, the device may determine the subspace $\hat{E}$ of eigenvector matrix E to include the given eigenvectors representative of given variances greater than variances represented by other eigenvectors in the eigenvector matrix E. In some examples, the subspace by various statistical methods such as principle component analysis, independent component analysis, or factor analysis.

In the example of principle component analysis, the eigenvector matrix E may be configured to include the eigenvectors sorted column-wise by the corresponding eigenvalues. For example, the first column may include the eigenvector $v_1$ with the highest eigenvalue (e.g., strongest eigenvector), and the second column may include the eigenvector $v_2$ with the second highest eigenvalue, and the last column may include the eigenvector $v_z$ having the lowest eigenvalue. Thus, for example, selection of the subspace $\hat{E}$ may correspond to selecting the first K eigenvectors in the eigenvector matrix E.

In some examples, the number of the eigenvectors K included in the subspace $\hat{E}$ may be a given quantity. For example, the device may determine the subspace $\hat{E}$ to include the first K=3 eigenvectors in the eigenvector matrix E. In other examples, the subspace $\hat{E}$ may be configured to include eigenvectors that have eigenvalues greater than a threshold value. For example, K may be selected such that the variance of the principle subspace is a given percentage of the overall variance of the correlation matrix C. The determination of such K may be expressed as:

$$K = \text{argmin}_K \left\{ \frac{\sum_{k=1}^{K} e_k}{\sum_{k=1}^{P} e_k} <= \text{threshold} \right\} \quad [2]$$

where $e_k$ corresponds to a given eigenvalue that corresponds to a given eigenvector $v_k$. In some examples, the threshold value illustrated in equation [2] may represent dimensions of the eigenvector matrix E that do not pertain to noise in the correlation matrix C (e.g., discard 98% of the eigenvectors associated with the lowest variances). In these examples, the number of eigenvectors (e.g., K) may be 2 to 7 eigenvectors, for example. Thus, in some examples, the subspace $\hat{E}$ may have P by K dimensions where K is less than P.

At block 308, the method 300 includes determining local weights for the individual costs based on the subspace. The given individual cost may be weighted based on a given local weight of the local weights.

Referring to the example at block 306, the subspace $\hat{E}$ was determined by transforming the eigenvector matrix E from P by P dimensions to P by K dimensions. In some examples, determining the local weights may correspond to transforming the subspace $\hat{E}$ back to P by P dimensions. For example, a local weights matrix $W_l$ having P by P dimensions may be expressed as:

$$W_l = \frac{1}{2} E \hat{E}^T \quad [3]$$

Thus, for example, the local weights matrix $W_l$ described in equation [3] may be utilized as a transformation matrix to apply the local weights to the individual costs. For example, the costs may be represented as a cost vector $C_l$ that includes a sum of the individual costs for each join in the plurality of joins. In this example, the weighted local costs $\hat{C}_l$ may be expressed as:

$$\hat{C}_l = W_l \hat{C}_l \quad [4]$$

Additionally, in some examples, the local weights matrix $W_l$ may be calculated once and reused whenever the plurality of joins is analyzed. For example, a TTS may receive input text such as "the can has food for the cat," and may utilize the local weights matrix $W_l$ for selecting speech sounds for the letters "ca" in the word "can" and the word "cat." Thus, for example, $\hat{C}_l$ in equation [4] may include the local cost calculations for all the joins in the plurality of joins.

Additionally, in some examples, the local weights may be combined with global weights such as the global weights discussed in the method 200. For example, where the global weights are expressed as $W_g$, the weighted local costs may be expressed as:

$$\hat{C}_l = W_l W_g C_l \quad [5]$$

Thus, in some examples, the local weights matrix $W_l$ may be utilized to modify a Viterbi search algorithm, such the algorithm discussed in the description of the device 100 of FIG. 1, to weight the local costs when determining a sequence of speech sounds that correspond to a pronunciation of text by a TTS.

In some examples, the method 300 includes removing noise from the individual costs by weighting the individual costs based on the subspace $\hat{E}$ as described above. For example, by excluding eigenvectors that represent variance below the threshold value, the remaining eigenvectors may be utilized to weigh the individual costs accordingly and apply a greater weight for individual costs exhibiting higher variability than corresponding weights for individual costs exhibiting lower variability. It is noted that in some examples, the local weights determined by the method 300 may include negative weights for some of the individual costs.

Figure 4:
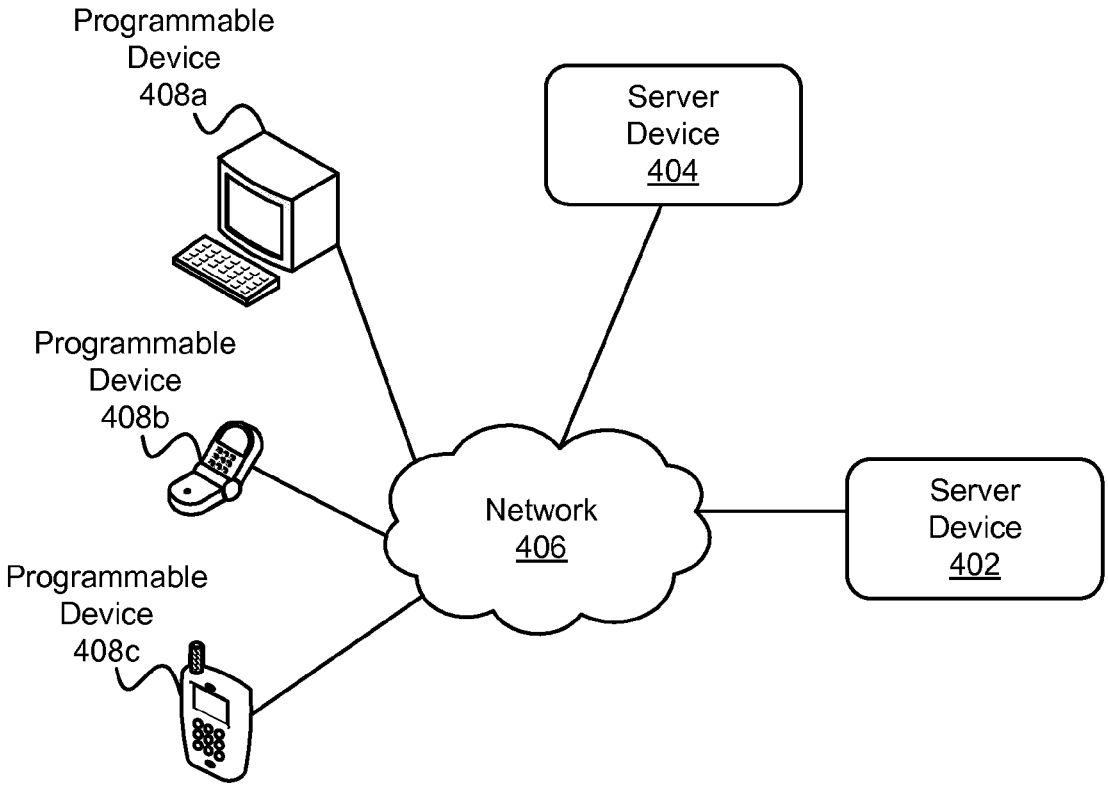
FIG. 4 illustrates an example distributed computing architecture, in accordance with at least some embodiments described herein.

FIG. 4 illustrates an example distributed computing architecture, in accordance with an example embodiment. FIG. 4 shows server devices 402 and 404 configured to communicate, via network 406, with programmable devices 408*a*, 408*b*, and 408*c*. The network 406 may correspond to a LAN, a wide area network (WAN), a corporate intranet, the public Internet, or any other type of network configured to provide a communications path between networked computing devices. The network 406 may also correspond to a combination of one or more LANs, WANs, corporate intranets, and/or the public Internet.

Although FIG. 4 shows three programmable devices, distributed application architectures may serve tens, hundreds, or thousands of programmable devices. Moreover, the programmable devices 408*a*, 408*b*, and 408*c* (or any additional programmable devices) may be any sort of computing device, such as an ordinary laptop computer, desktop computer, network terminal, wireless communication device (e.g., a tablet, a cell phone or smart phone, a wearable computing device, etc.), and so on. In some examples, the programmable devices 408*a*, 408*b*, and 408*c* may be dedicated to the design and use of software applications. In other examples, the programmable devices 408*a*, 408*b*, and 408*c* may be general purpose computers that are configured to perform a number of tasks and may not be dedicated to software development tools. For example the programmable devices 408*a*-408*c* may be configured to provide speech synthesis functionality similar to that discussed in FIGS. 1-3. For example, the programmable devices 408*a-c* may include a device such as the device 100.

The server devices 402 and 404 can be configured to perform one or more services, as requested by programmable devices 408*a*, 408*b*, and/or 408*c*. For example, server device 402 and/or 404 can provide content to the programmable devices 408*a*-408*c*. The content can include, but is not limited to, web pages, hypertext, scripts, binary data such as compiled software, images, audio, and/or video. The content can include compressed and/or uncompressed content. The content can be encrypted and/or unencrypted. Other types of content are possible as well.

As another example, the server device 402 and/or 404 can provide the programmable devices 408*a*-408*c* with access to software for database, search, computation (e.g., text-to-speech synthesis), graphical, audio, video, World Wide Web/Internet utilization, and/or other functions. Many other examples of server devices are possible as well. In some examples, the server devices 402 and/or 404 may perform functions described in FIGS. 1-3.

The server devices 402 and/or 404 can be cloud-based devices that store program logic and/or data of cloud-based applications and/or services. In some examples, the server devices 402 and/or 404 can be a single computing device residing in a single computing center. In other examples, the server device 402 and/or 404 can include multiple computing devices in a single computing center, or multiple computing devices located in multiple computing centers in diverse geographic locations. For example, FIG. 4 may depict the server devices 402 and 404 residing in different physical locations.

In some examples, data and services at the server devices 402 and/or 404 can be encoded as computer readable information stored in non-transitory, tangible computer readable media (or computer readable storage media) and accessible by programmable devices 408*a*, 408*b*, and 408*c*, and/or other computing devices. In some examples, data at the server device 402 and/or 404 can be stored on a single disk drive or other tangible storage media, or can be implemented on multiple disk drives or other tangible storage media located at one or more diverse geographic locations.

Figure 5:
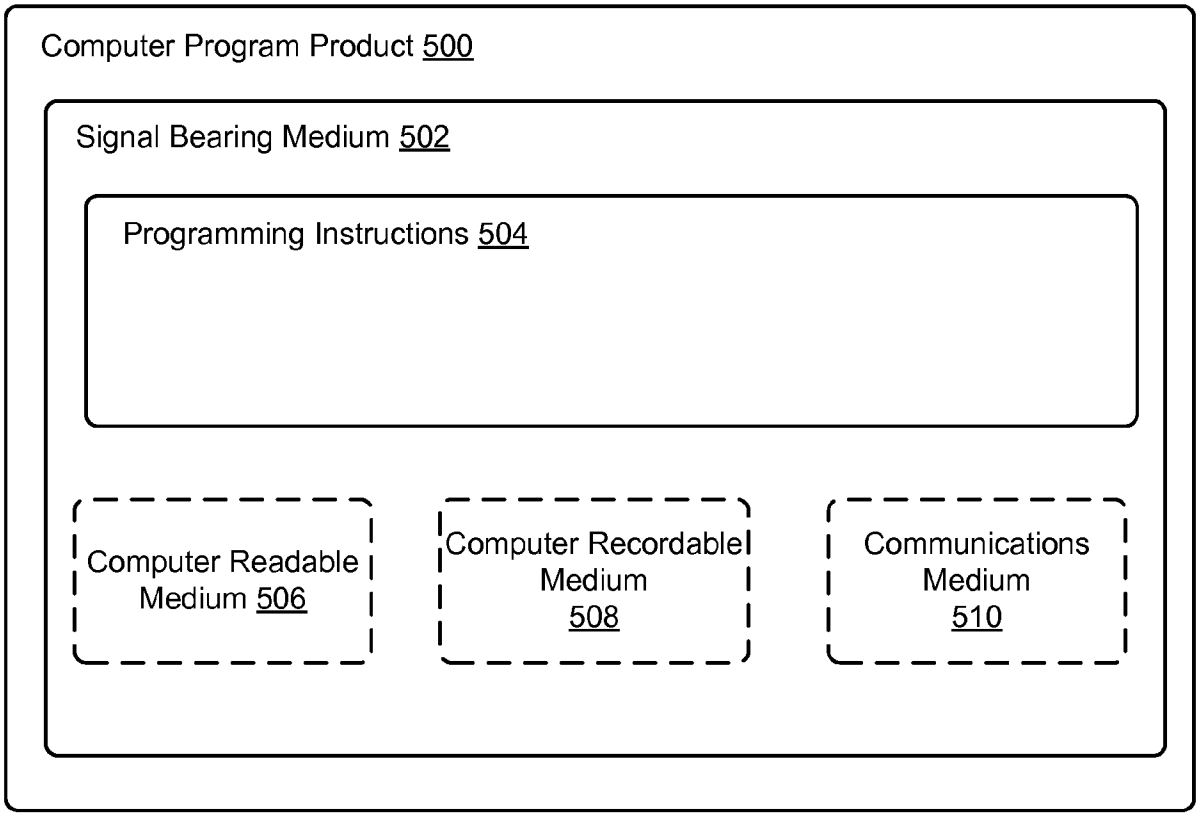
FIG. 5 depicts an example computer-readable medium configured according to at least some embodiments described herein.

FIG. 5 depicts an example computer-readable medium configured according to at least some embodiments described herein. In example embodiments, the example system can include one or more processors, one or more forms of memory, one or more input devices/interfaces, one or more output devices/interfaces, and machine readable instructions that when executed by the one or more processors cause the system to carry out the various functions tasks, capabilities, etc., described above.

As noted above, in some embodiments, the disclosed techniques (e.g. methods 200 and 300) can be implemented by computer program instructions encoded on a computer readable storage media in a machine-readable format, or on other media or articles of manufacture (e.g., the instructions stored on the memory 118 of the device 100, or the instructions that operate the server devices 402-404 and/or the programmable devices 408*a*-408*c* in FIG. 4). FIG. 5 is a schematic illustrating a conceptual partial view of an example computer program product that includes a computer program for executing a computer process on a computing device, arranged according to at least some embodiments disclosed herein.

In one embodiment, the example computer program product 500 is provided using a signal bearing medium 502. The signal bearing medium 502 may include one or more programming instructions 504 that, when executed by one or more processors may provide functionality or portions of the functionality described above with respect to FIGS. 1-4. In some examples, the signal bearing medium 502 can be a computer-readable medium 506, such as, but not limited to, a hard disk drive, a Compact Disc (CD), a Digital Video Disk (DVD), a digital tape, memory, etc. In some implementations, the signal bearing medium 502 can be a computer recordable medium 508, such as, but not limited to, memory, read/write (R/W) CDs, R/W DVDs, etc. In some implementations, the signal bearing medium 502 can be a communication medium 510 (e.g., a fiber optic cable, a waveguide, a wired communications link, etc.). Thus, for example, the signal bearing medium 502 can be conveyed by a wireless form of the communications medium 510.

The one or more programming instructions 504 can be, for example, computer executable and/or logic implemented instructions. In some examples, a computing device such as the processor-equipped devices 100 and programmable devices 408*a-c* of FIGS. 1 and 4 is configured to provide various operations, functions, or actions in response to the programming instructions 504 conveyed to the computing device by one or more of the computer readable medium 506, the computer recordable medium 508, and/or the communications medium 510. In other examples, the computing device can be an external device such as server devices 402-404 of FIG. 4 in communication with a device such as device 100 or programmable devices 408*a*-408*c*.

The computer readable medium 506 can also be distributed among multiple data storage elements, which could be remotely located from each other. The computing device that executes some or all of the stored instructions could be an external computer, or a mobile computing platform, such as a smartphone, tablet device, personal computer, wearable device, etc. Alternatively, the computing device that executes some or all of the stored instructions could be remotely located computer system, such as a server. For example, the computer program product 500 can implement the functionalities discussed in the description of FIGS. 1-3.

It should be understood that arrangements described herein are for purposes of example only. As such, those skilled in the art will appreciate that other arrangements and other elements (e.g. machines, interfaces, functions, orders, and groupings of functions, etc.) can be used instead, and some elements may be omitted altogether according to the desired results. Further, many of the elements that are described are functional entities that may be implemented as discrete or distributed components or in conjunction with other components, in any suitable combination and location, or other structural elements described as independent structures may be combined.

While various aspects and embodiments have been disclosed herein, other aspects and embodiments will be apparent to those skilled in the art. The various aspects and embodiments disclosed herein are for purposes of illustration and are not intended to be limiting, with the true scope being indicated by the following claims, along with the full scope of equivalents to which such claims are entitled. It is also to be understood that the terminology used herein is for the purpose of describing particular embodiments only, and is not intended to be limiting.

What is claimed is:

1. A method comprising:

determining, by a computing device, a representation of text that includes a first linguistic term associated with a first set of speech sounds that include pronunciations of the first linguistic term, and a second linguistic term associated with a second set of speech sounds that include pronunciations of the second linguistic term;

determining, by the computing device, a plurality of joins between the first set and the second set, wherein a given join is indicative of concatenating a first speech sound from the first set with a second speech sound from the second set, wherein a given local cost of the given join corresponds to a weighted sum of individual costs, wherein a given individual cost is weighted based on a variability of the given individual cost in the plurality of joins;

determining the variability of the given individual cost based on at least a number of speech sounds in the first set of speech sounds and the second set of speech sounds; and providing, by the computing device, a synthetic speech audio signal comprising a sequence of speech sounds indicative of a pronunciation of the text based on a minimization of a sum of local costs of adjacent speech sounds in the sequence, wherein the first speech sound and the second speech sound are included in the sequence based on the given local cost of the given join minimizing the sum.

2. The method of claim 1, further comprising:

determining, by the computing device, a correlation representation of the individual costs in the plurality of joins indicative of the variability of the given individual cost, wherein the given individual cost is weighted based on the correlation representation.

3. The method of claim 2, further comprising:

determining, by the computing device, a subspace of an eigenvector representation of the correlation representation, wherein the subspace includes given eigenvectors representative of given variances greater than variances represented by other eigenvectors in the eigenvector representation; and determining, based on the subspace, local weights for the individual costs, wherein the given individual cost is weighted based on a given local weight of the local weights.

4. The method of claim 3, wherein the subspace is configured to include the given eigenvectors that have eigenvalues greater than a threshold value.

5. The method of claim 3, wherein the subspace is configured to include a given quantity of the given eigenvectors.

6. The method of claim 3, wherein the subspace is determined based on principle component analysis, independent component analysis, or factor analysis.

7. The method of claim 1, wherein the individual costs are indicative of a likelihood that acoustic features of the first speech sound and the second speech sound correspond to the first linguistic term and the second linguistic term, and wherein the individual costs are indicative of an acoustic transition between the first speech sound and the second speech sound.

8. The method of claim 1, wherein the first linguistic term and the second linguistic term include one or more phonemes.

9. A non-transitory computer readable medium having stored therein instructions, that when executed by a computing device, cause the computing device to perform operations, the operations comprising:

determining a representation of that includes a first linguistic term associated with a first set of speech sounds that include pronunciations of the first linguistic term, and a second linguistic term associated with a second set of speech sounds that include pronunciations of the second linguistic term;

determining a plurality of joins between the first set and the second set, wherein a given join is indicative of concatenating a first speech sound from the first set with a second speech sound from the second set, wherein a given local cost of the given join corresponds to a weighted sum of individual costs, wherein a given individual cost is weighted based on a variability of the given individual cost in the plurality of joins;

determining the variability of the given individual cost based on at least a number of speech sounds in the first set of speech sounds and the second set of speech sounds; and providing a synthetic speech audio signal comprising a sequence of speech sounds indicative of a pronunciation of the text based on a minimization of a sum of local costs of adjacent speech sounds in the sequence, wherein the first speech sound and the second speech sound are included in the sequence based on the given local cost of the given join minimizing the sum.

10. The non-transitory computer readable medium of claim 9, the operations further comprising:

determining a correlation representation of the individual costs in the plurality of joins indicative of the variability of the given individual cost, wherein the given individual cost is weighted based on the correlation representation.

11. The non-transitory computer readable medium of claim 10, the operations further comprising:

determining a subspace of an eigenvector representation of the correlation representation, wherein the subspace includes given eigenvectors representative of given variances greater than variances represented by other eigenvectors in the eigenvector representation; and determining, based on the subspace, local weights for the individual costs, wherein the given individual cost is weighted based on a given local weight of the local weights.

12. The non-transitory computer readable medium of claim 11, wherein the subspace is configured to include the given eigenvectors that have eigenvalues greater than a threshold value.

13. The non-transitory computer readable medium of claim 11, wherein the subspace is configured to include a given quantity of the given eigenvectors.

14. The non-transitory computer readable medium of claim 11, wherein the subspace is determined based on principle component analysis, independent component analysis, or factor analysis.

15. A computing device comprising:

one or more processors; and data storage configured to store instructions, that when by the one or more processors, cause the computing device to:

determine a representation of that includes a first linguistic term associated with a first set of speech sounds that include pronunciations of the first linguistic term, and a second linguistic term associated with a second set of speech sounds that include pronunciations of the second linguistic term;

determine a plurality of joins between the first set and the second set, wherein a given join is indicative of concatenating a first speech sound from the first set with a second speech sound from the second set, wherein a given local cost of the given join corresponds to a weighted sum of individual costs, wherein a given individual cost is weighted based on a variability of the given individual cost in the plurality of joins; and determine the variability of the given individual cost based on at least a number of speech sounds in the first set of speech sounds and the second set of speech sounds; and provide a synthetic speech audio signal comprising a sequence of speech sounds indicative of a pronunciation of the text based on a minimization of a sum of local costs of adjacent speech sounds in the sequence, wherein the first speech sound and the second speech sound are included in the sequence based on the given local cost of the given join minimizing the SUM.

16. The computing device of claim 15, wherein the instructions further cause the computing device to:

determine a correlation representation of the individual costs in the plurality of joins indicative of the variability of the given individual cost, wherein the given individual cost is weighted based on the correlation representation.

17. The computing device of claim 16, wherein the instructions further cause the computing device to:

determine a subspace of an eigenvector representation of the correlation representation, wherein the subspace includes given eigenvectors representative of given variances greater than variances represented by other eigenvectors in the eigenvector representation; and determine, based on the subspace, local weights for the individual costs, wherein the given individual cost is weighted based on a given local weight of the local weights.

18. The computing device of claim 16, wherein the subspace is configured to include the given eigenvectors that have eigenvalues greater than a threshold value.

19. The computing device of claim 16, wherein the subspace is configured to include a given quantity of the given eigenvectors.

20. The computing device of claim 16, wherein the subspace is determined based on principle component analysis, independent component analysis, or factor analysis.

* * * * *